United States Patent [19]

Arendt et al.

[11] 4,082,566

[45] Apr. 4, 1978

[54] MOLTEN SALT LEACH FOR REMOVAL OF INORGANIC CORES FROM DIRECTIONALLY SOLIDIFIED EUTECTIC ALLOY STRUCTURES

[75] Inventors: Ronald H. Arendt; Marcus P. Borom; Irvin C. Huseby, all of Schenectady; Frederic J. Klug, Amsterdam, all of N.Y.

[73] Assignee: General Electric Company, Schenectady, N.Y.

[21] Appl. No.: 775,749

[22] Filed: Mar. 9, 1977

[51] Int. Cl.[2] ..... B08B 3/10; B22D 29/00

[52] U.S. Cl. ..... 134/2; 134/21; 134/22 R; 134/30; 134/34; 164/132

[58] Field of Search ..... 134/21, 26, 30, 2, 22 R, 134/34; 164/132

[56] References Cited

U.S. PATENT DOCUMENTS 3,957,104 5/1976 Terpay ..... 164/132

OTHER PUBLICATIONS

*Chem. Abstracts,* Abstract No. 4676h, vol. 62, 1965, p. 4676.

*Primary Examiner*—S. Leon Bashore
*Assistant Examiner*—Marc L. Caroff
*Attorney, Agent, or Firm*—Donald M. Winegar; Joseph T. Cohen; Jerome C. Squillaro

[57] ABSTRACT

Cores made of either $Y_2O_3$, $Y_3Al_5O_{12}$, $LaAlO_3$, $MgAl_2O_4$ or $Al_2O_3$ are removed from castings of advanced superalloy materials by immersion in a molten salt bath of either $Li_3AlF_6$ or a mixture of $CaF_2$ — NaF.

16 Claims, No Drawings

MOLTEN SALT LEACH FOR REMOVAL OF INORGANIC CORES FROM DIRECTIONALLY SOLIDIFIED EUTECTIC ALLOY STRUCTURES

RIGHTS GRANTED TO THE UNITED STATES OF AMERICA

The Government of the United States of America has rights in this invention pursuant to Contract No. F33615-76-C-5110 awarded by the Department of the Air Force.

BACKGROUND OF THE INVENTION

1. Field of the Invention

This invention relates to a molten salt leachant for core materials used in casting and solidifying advanced superalloy materials.

2. Description of the Prior Art

The production of intricate castings of directionally solidified (DS) eutectic alloys requires the use of chemically stable ceramic cores and molds. The currently available, $SiO_2$-based core materials do not possess the chemical stability required for casting eutectic alloys. New core materials based on $Al_2O_3$, $Y_2O_3$, $La_2O_3$ and/or MgO have been found to be chemically resistant to eutectic alloys under DS casting conditions. These new core materials are, however, generally inert to the leaching media used for the current $SiO_2$-based core materials.

At present silica cores are conventionally removed by leaching in caustic solutions in an autoclave. Several different techniques for core removal other than leaching have been suggested and some have been pursued at various levels. Among these are: techniques based on reactions of the core material to form volatile species such as refractory metal oxides; use of core materials that can be powdered by reactions like hydriding; and even mechanical core removal by techniques such as high pressure water blasts and ultrasonic disintegration. Very little success, however, has been experienced with mechanical core removal techniques on complicated blade configuration.

Chemical core removal techniques, including conventional leaching, present a basic contradiction for core materials selection. The alloy compatability requirement dictates outstanding chemical stability at high temperatures, while core removal requires high chemical reactivity under relatively mild conditions at low temperatures. This contradiction in chemical stability is the single most restrictive aspect of all the core material requirements. The development of new ceramic cores for eutectics should involve a thorough search for conventionally leachable ceramics; however, other ceramics that have potential for providing the required compatability must not be excluded. For the latter ceramics other core removal techniques must be developed.

New solvents are, therefore, required which are aggressive toward the ceramic but, at the same time, nondestructive toward the alloy. Molten salts have been found to satisfy the leachment requirements for these new core materials.

It is therefore an object of this invention to provide a new and improved leachant for ceramic cores employed in casting and solidifying advanced superalloy materials.

Another object of this invention is to provide a molten salt bath to leach core materials from advanced superalloy materials without detrimentally affecting the finish of the casting.

A further object of this invention is to provide a new and improved method to remove core materials from castings of advanced superalloy materials which includes a molten salt leachant and a molten salt rinse.

Other objects of this invention will, in part, be obvious and will, in part, appear hereinafter.

BRIEF DESCRIPTION OF THE INVENTION

In accordance with the teachings of this invention there is provided a new and improved method for removing core materials from castings of advanced superalloy materials. In leaching core materials comprising $Al_2O_3$, $LaAlO_3$, $Y_3Al_5O_{12}$ or $MgAl_2O_4$, the molten salt bath may comprise either $CaF_2$ — NaF or $Li_3AlF_6$. The salt baths are agitated by bubbling suitable gases such as, for example, inert gases and forming gas therethrough. The molten bath is maintained in an inert atmosphere. A suitable inert gas for both instances is nitrogen of less than 50 ppm oxygen.

The leaching casting is rinsed in a molten chloride bath and rinsed in water. A suitable molten chloride rinse bath is made of NaCl, KCl and LiCl salts. A preferred composition is 9 mole percent NaCl, 36 mole percent KCl and 55 mole percent LiCl.

DESCRIPTION OF THE INVENTION

New core materials based on $Al_2O_3$, $Y_2O_3$, $La_2O_3$ and/or MgO have been found suitable for use in casting and directional solidification of advanced superalloys such as NiTaC-13. We have discovered that the use of a molten salt leach will remove such core materials from a casting of the advanced superalloy material.

For basic or amphoteric oxide core materials, such as $Al_2O_3$ and $Y_2O_3$ molten salt solvents include the following:

$M_3AlF_6$
$M_3AlF_6 + MF$
$M_3AlF_6 + M'F_2$
$M_3AlF_6 + MCl$ where $M$ = Li, Na, K and
$M'$ = Mg, Ca, Ba, Sr It is important that the purity of the molten salt be maintained at a high degree so that the leaching affect of the bath is not diminished. Further, a controlled atmosphere is also desirable to prevent oxidation of the salt pot and the casting, which can introduce impurities into the salt bath or accidental failure of the pot or container. The molten salt is also agitated to help maintain its leaching effect.

The controlled atmosphere for covering the molten salt bath is one of the gases selected from the group consisting of argon, neon, hydrogen, nitrogen and helium. Suitable gases for bubbling through the molten salt bath are nitrogen, forming gas (5% to 10% by volume hydrogen, balance nitrogen) and argon.

The fluoride salts and the fluoride products from leaching are insoluble in water. Therefore a molten chloride salt bath is provided to serve as a rinse between the fluoride bath and a final water rinse. A suitable chloride rinse has been produced by employing a molten bath of NaCl, KCl and LiCl. The composition by mole percent is NaCl 9 mole percent, KCl 36 mole percent and LiCl 55 mole percent. The melting temperature of the salt rinse is 346° C, its eutectic temperature.

Each salt bath is placed in a facility which is evacuated and then flushed with either an inert gas or a reducing gas, such as forming gas during melt down. The salt is purified by electrolysis. For a bath containing from 10 kilograms to 15 kilograms of salt, the molten salt baths are exposed to from 70 to 80 amp-hours of electrolysis at the maximum use temperature of that particular bath. The cleanliness of the salt is determined by visually observing the pick up on the cathode and by weighing the cathode after removal of the salt layer to determine the rate of purification by metalliding. The cathodes may be of iron, nickel, and the like. A suitable material for anodes is pyrolytic graphite.

To determine the reactivity of different salt baths with the various candidate ceramic materials for core materials, pellets of the same were made by pressing and sintering high purity (>99%) and preferably about 99.9% pure single oxide materials. Prior to and after each leaching trial, Archimedian and geometric density measurements were made on each pellet specimen. Each pellet specimen was also characterized by x-ray diffraction, fluorescence, scanning electron microscopy, metallography and electron microprobe analysis for microstructure and for phase content and distribution.

A sodium fluoride-calcium fluoride bath was prepared wherein sodium fluoride (NaF) comprised 67 mole percent of the bath. The remainder, 33 mole percent, was calcium fluoride ($CaF_2$). The melting temperature was the eutectic temperature 810° C. Nitrogen gas was employed as a flowing gas cover and as a bubbler gas to stir the salt bath.

A core sample made of stoichiometric magnesium aluminate spinel, $MgAl_2O_4$, having a density of 70 percent was placed in the bath heated to 900° C ± 10° C. After 11.7 hours, the core sample was removed, rinsed in the salt bath heated to 600° C ± 25° C, followed by a water rinse.

The core sample had partially disintegrated indicating that the NaF — $CaF_2$ salt bath was a suitable leachant.

Other core samples of the same material were also tested in the salt bath. Two more were placed in the bath at 900° C for 4.7 hours and 14.3 hours respectively. Each core sample gained weight and did not disintegrate.

The bath temperature was raised to 1000° C ± 10° C and four more core samples of the same material were placed in the salt bath for periods of time of 1.0, 4.8, 13 and 25, hours respectively. The first three samples lost weight, but did not disintegrate and the last sample actually gained weight.

An examination of these six core samples revealed that an outer layer of $Cr_2O_3$ had formed on each core sample. Additionally, an intermediate layer of chrome-magnesium aluminate was also discovered. An investigation of the facilities lead to the discovery that oxygen had inadvertently been introduced into the salt chamber and oxidation of the Inconel salt pot had occurred. Chromium oxide from oxidation of the pot contaminated the salt bath. An analysis of the nitrogen gas revealed a content of 1000 ppm $O_2$.

This clearly indicates the necessity for maintaining a good controlled atmosphere for the leaching salt baths and the purity of the gases employed. The oxygen content of the nitrogen, or other gases, must be less than 50 ppm.

A second leaching salt bath was made employing only $Li_3AlF_6$ which has a melting temperature of 790° C. The bath was employed at 1000° C for periods of time ranging from one half hour (½ hour) to 17.5 hours. The controlled atmosphere was nitrogen maintained at a positive pressure of 4 inches water. This was obtained by a bypass on the nitrogen line and produced a stagnant cover of gas. The bubbler gas for agitation was forming gas of composition 90% nitrogen - 10% hydrogen by volume. The previously described chloride salt bath was employed to rinse the samples prior to a water rinse.

Core samples of $MgAl_2O_4$, $LaAlO_3$, $Y_3Al_5O_{12}$ were leached at reasonable rates to make $Li_3AlF_6$ an acceptable leachant salt.

In employing the salt baths it is therefore important that contaminants be kept from the baths to maintain their leaching effort. In particular, a stagnant inert gas atmosphere is preferred as a cover gas for the bath when the inert gas atmosphere contains too great an amount of oxygen therein. If the inert gas has an oxygen content of less than 50 ppm, then a flowing gas atmosphere can be employed. This same problem prevents the use of the inert gas as a bubbler when the oxygen content is too great. Therefore, it is preferred that the bubbler gas be forming gas of a composition of 90% nitrogen, 10% hydrogen by volume.

Other suitable gases for either a covering gas or a bubbler gas are helium, argon, neon and hydrogen.

Samples of castings of advanced superalloy materials, such as NiTaC-13, were immersed in the various salt bases to study the effect the baths had on the surface finish of the castings. Examination of the castings showed that the rinse bath, NaCl, KCl and LiCl, the solvent bath NaF—$CaF_2$, and the solvent bath $Li_3AlF_6$ did not detrimentally affect the surface finish of the castings.

When the leachant or solvent bath is of $Li_3AlF_6$, it is desirable to have either an excess of LiF or $AlF_3$ salt rinse therein in order to maintain a stoichiometric mixture. The excess salt added depends upon how one makes up the mixture and on which side of the stoichiometric composition one desires to be.

We claim as our invention:

1. A method for removing ceramic cores from castings of superalloy materials including the process steps of a. preparing a molten salt bath of a leachant salt composition which is one selected from the group consisting of $M_3AlF_6$, $M_3AlF_6$ + MF, $M_3AlF_6$ + $M'F_2$ and $M_3AlF_6$ + MCl wherein
   M is a chemical element selected from the group consisting of Li, Na and K, and
   M′ is a chemical element which is one selected from the group consisting of Mg, Ca, Ba and Sr;
b. covering the molten salt bath with an inert atmosphere having an oxygen content of less than 50 p.p.m.;
c. immersing the casting and the ceramic core in the molten salt bath;
d. leaching the core material from the casting in the molten salt bath, and
e. rinsing the casting to remove leachant products from the casting.

2. The method of claim 1 and including
agitating the molten bath during the time the casting and core are immersed therein.

3. The method of claim 1 wherein the rinsing of the leached casting is practiced in a salt bath of NaCl, KCl and LiCl.

4. The method of claim 3 wherein the composition of the salt bath for rinsing is NaCl 9 mole percent, KCl 36 mole percent and LiCl 55 mole percent.

5. The method of claim 2 wherein the rinsing of the leached casting is practiced in a salt bath of NaCl, KCl and LiCl.

6. The method of claim 5 wherein the composition of the salt bath for rinsing is NaCl 9 mole percent, KCl 36 mole percent and LiCl 55 mole percent.

7. The method of claim 3 wherein the molten bath is agitated by bubbling a gas through the bath.

8. The method of claim 7 wherein the leachant salt is $Li_3AlF_6$.

9. The method of claim 8 wherein the inert atmosphere is nitrogen.

10. The method of claim 9 wherein the bubbler gas is forming gas.

11. The method of claim 8 wherein the leachant salt contains an excess of a salt which is one selected from the group consisting of LiF and $AlF_3$.

12. The method of claim 2 wherein the inert atmosphere is a gas which is one selected from the group consisting of argon, neon, hydrogen, nitrogen and helium.

13. The method of claim 2 wherein the inert atmosphere is formed by a flowing gas which has an oxygen content less than 50 ppm.

14. The method of claim 2 wherein agitating of the molten salt bath is practiced by bubbling a gas through the molten salt bath.

15. The method of claim 14 wherein the gas bubbled through the molten bath is one selected from the group consisting of nitrogen gas, hydrogen gas, forming gas, helium gas, argon gas and neon gas.

16. The method of claim 15 wherein the gas is forming gas of a cmposition of about 5 to 10% by volume hydrogen, balance nitrogen.

* * * * *